United States Patent [19]

Rodaway

[11] 3,990,744

[45] Nov. 9, 1976

[54] WHEELCHAIR FOOT REST

[75] Inventor: Keith Samuel Rodaway, Culver City, Calif.

[73] Assignee: Everest & Jennings, Inc., Los Angeles, Calif.

[22] Filed: Oct. 24, 1975

[21] Appl. No.: 625,457

[52] U.S. Cl. ..... 297/433; 297/DIG. 4; 297/427; 403/372; 403/371

[51] Int. Cl.[2] ..... A47C 7/50

[58] Field of Search ..... 297/427, DIG. 4, 433; 403/84, 359, 371, 372, 367, 368

[56] References Cited

UNITED STATES PATENTS

| | | | |
|---|---|---|---|
| 1,443,041 | 1/1923 | Richmond | 403/84 |
| 2,591,246 | 4/1952 | Everest et al. | 297/DIG. 4 |
| 2,841,208 | 7/1958 | Duke | 297/DIG. 4 |
| 3,863,984 | 2/1975 | Sickels | 297/427 |

*Primary Examiner*—Roy D. Frazier
*Assistant Examiner*—Peter A. Aschenbrenner
*Attorney, Agent, or Firm*—Ralph B. Pastoriza

[57] ABSTRACT

The wheelchair foot rest comprises a plate portion with a semi-cylindrical configuration journalling a tube in turn supported to the wheelchair such that the plate can swing from a horizontal position to a vertical position about the journalling axis. Axially slotted plastic friction sleeves surround the journalling tube in such a manner as to lock to the inner wall ends of the semi-cylindrical portion of the plate and frictionally engage the periphery of the journalling tube so that the plate is held in any set swung position.

2 Claims, 4 Drawing Figures

WHEELCHAIR FOOT REST

This invention relates generally to wheelchairs and more particularly to an improved foot rest structure for wheelchairs.

BACKGROUND OF THE INVENTION

Conventional wheelchair foot rests usually take the form of a flat plate member journalled at one side edge for rotation about a forwardly extending journalling tube so that the plate may be swung from a generally horizontal to a generally vertical position to provide easy access for a patient into the wheelchair. After the patient is seated, the foot rest plates are swung downwardly to a substantially level or horizontal position and the patient's feet placed on the rests.

In order to avoid the necessity of a nurse or doctor holding the foot rest plate in a generally vertical plane when it is swung upwardly, the foot rest structure is designed to hold itself in a generally vertical plane once it has been swung to that position. A common means for accomplishing this holding of the foot rest plate is to provide a small metallic leaf type spring which exerts a friction force against the journalling tube and is normally secured to an underside portion of the plate itself.

With structures of the foregoing type, the journalling tube itself which is normally chrome-plated becomes scratched and worn by continuous contact with the leaf spring. Moreover, corrosion can eventually take place making it very difficult to move the foot rest plates, particularly if the wheelchair has not been in use for along period of time. On the other hand, when a wheelchair is in constant use, so that the foot rest plate is raised and lowered many times, the effectiveness of the frictional engagement of the leaf spring with the journalling tube decreases to the extent that proper holding of the plate in a swung or set position is not always assured.

In other proposed designs, simple friction means such as 0-rings have been proposed, but such of these solutions as have been tried have resulted in annoying squeaking noises when the plate is moved.

The foregoing problems could be overcome by providing more complicated arrangements such as spring-actuated detent balls and suitable dimples and the like. Such proposed solutions merely increase the overall manufacturing expense and again relies on a spring which can eventually become worn and lose its elastic properties constituting a disadvantage. In addition, with certain types of indexing means, the swung plate is only held in the two positions, to wit: the horizontal used position or the vertical, out-of-the-way position. In some instances, it might be desirable to have the plate secured in any intermediate swung position. Moreover, even with the more expensive sophisticated versions, the apparatus is still susceptible to squeaking noises.

BRIEF DESCRIPTION OF THE PRESENT INVENTION

With the foregoing considerations in mind, the present invention contemplates a vastly improved and simplified arrangement which functions to hold a foot rest plate in any desired swung position and which simultaneously avoids problems heretofore associated with such structures.

More particularly, the invention comprises a journalling tube rigidly secured at one end adjacent to the lower end of a suitable support tube, the upper end of which is adapted to be secured to a wheelchair. A foot rest plate is provided with an integrally formed semi-cylindrical configuration along one side defining journalling openings at its ends for receiving the journalling tube such that the plate may be swung from a generally horizontal plane into a generally vertical plane about an axis coaxial with the journalling tube and semi-cylindrical configuration. Two axially slotted friction sleeves surround the journalling tube at the journalling openings so as to frictionally engage the tube and simultaneously lock to the inside semi-cylindrical journal wall ends of the semi-cylindical configuration portion of the plate.

With the foregoing arrangement, the plate may be easily and silently swung to any desired position and it will be held in its swung position by friction between the sleeves and the journalling tube periphery. The arrangement is extremely simple, economical to manufacture and will not in any way sratch or mar the chrome-plated journalling tube or other portions of the structure. Moreover, the installation is extremely simple and will operate reliably over a long period of time. In the event the chrome-plated journalling tube becomes worn, the sleeves automatically radially contract to thereby still exert sufficient frictional force on the tube to hold the plate in any set position. By utilizing a high grade plastic material for the sleeves, squeaking is wholly avoided.

BRIEF DESCRIPTION OF THE DRAWINGS

A better understanding of the invention will be had by referring to a preferred embodiment thereof as illustrated in the accompanying drawings in which.

DETAILED DESCRIPTION OF THE PREFERRED EMBODIMENT

Figure 1:
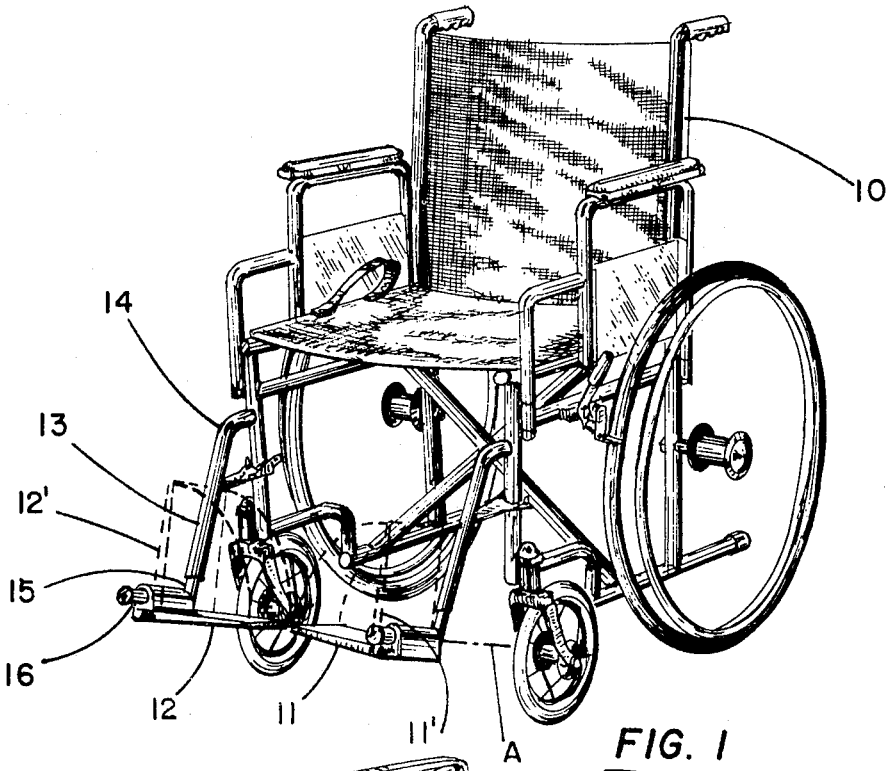
FIG. 1 is a front perspective view of a wheelchair having foot rests designed in accord with the present invention.

Referring first to FIG. 1 there is shown a conventional wheelchair 10 having front left and right foot rest plates designated 11 and 12 respectively. The structure of these foot rests in accord with the present invention constitutes mirror images of each other and therefore a detailed description of one will suffice for both.

Thus, with reference to the foot rest 12 the structure includes an elongated support tube 13 having an upper end 14 adapted for securement to the front of the wheelchair. The tube has rigidly secured adjacent to its lower end 15 a journalling tube 16. Tube 16 extends generally horizontally forwardly to terminate in a free end and functions to journal the foot rest plate 12. The arrangement is such that the plate 12 may swing from a generally level horizontal position into a generally vertical plane as indicated at 12' in dotted lines.

it will be understood that this same foregoing action will reposition the foot rest plate 11 to the dotted line position 11' to thereby provide for easy access to or exit from the wheelchair by a patient.

Figure 2:
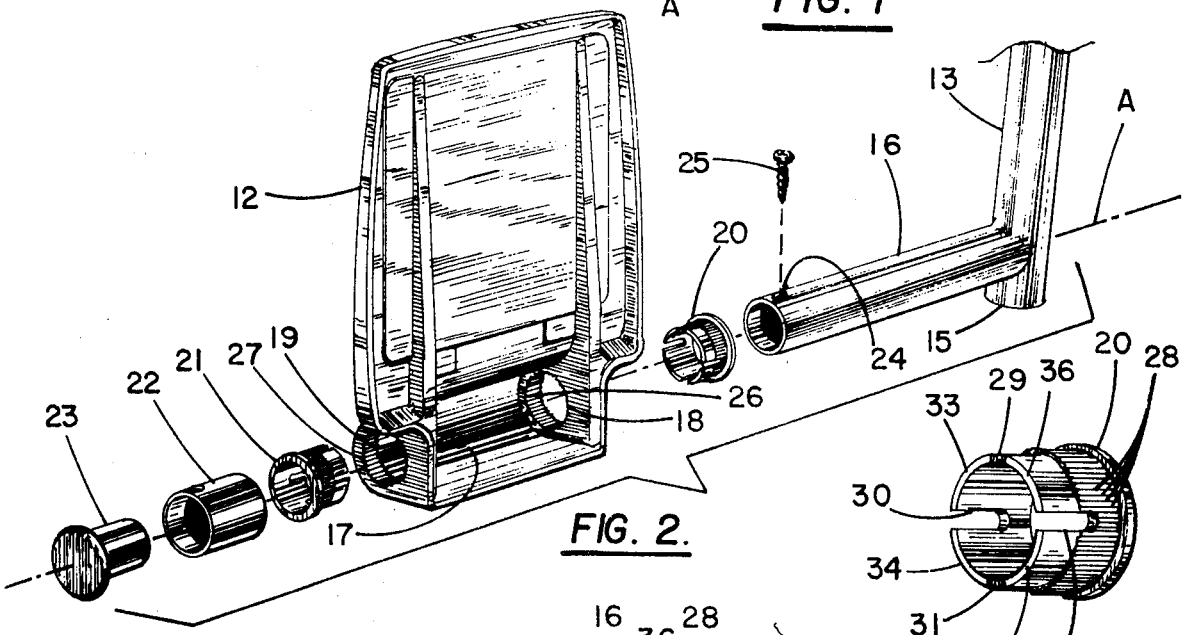
FIG. 2 is an enlarged fragmentary exploded view of the basic components making up the foot rest.

Referring now to FIG. 2, further details of the foot rest assembly will be evident. In the exploded view of FIG. 2 the foot rest plate 12 is shown generally in a vertical plane separated from the journalling tube 16. This plate has an integrally formed semi-cylindrical configuration 17 along its lower side as viewed in FIG. 2 defining journalling openings at its ends as indicated at 18 and 19 for receiving the journalling tube 16.

In order that the foot rest plate will be held in any swung set position in accord with the present invention, there are provided a pair of friction sleeves shown respectively at 20 and 21 arranged to be received in the journalling openings. As will become clearer as the description proceeds, these friction sleeves include means for locking them against rotation within the journalling openings and further resilient means biasing them into frictional engagement with the periphery of the journalling tube 16.

Still referring to FIG. 2, there is additionally shown an end collar 22 and end cap 23 which engage the end portion 24 of the journalling tube 16 when the same is assembled within the semi-cylindrical portion of the plate 12. A rivet or screw 25 secures the end collar 22 and end cap 23 in place. The diameter of the collar 22 is larger than the inner diameter of the journalling opening 19 so that the plate 12 is prevented from moving off the end of the journalling tube 16.

It will be noted in FIG. 2 that in the preferred embodiment disclosed, each of the journalling openings 18 and 19 includes axially extending grooves 26 and 27 about their inner peripheries. These grooves cooperate with the heretofore referred to means for locking the sleeves 20 and 21 within the journalling openings.

Figure 3:
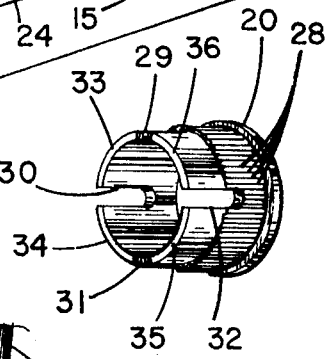
FIG. 3 is an enlarged perspective view of one of the slotted friction sleeves shown in FIG. 2; and, FIG. 4 is a fragmentary underside view of the assembled foot rest structure.

The foregoing will better be understood by now referring to the enlarged perspective view of FIG. 3 illustrating the friction sleeve 20. It will be understood that the friction sleeve 21 is of identical construction and thus a detailed description of the sleeve 20 will suffice for both.

As shown in FIG. 3 there are provided axially extending ribs 28 on a rear cylindrical portion of the sleeve 20, these ribs being received in the corresponding grooves 26 for the journalling opening as described in FIG. 2 to thereby lock the sleeve to the journalling opening against rotation.

The heretofore referred to resilient friction means provided by the sleeve 20 takes the form in the embodiment disclosed of a forward cylindrical portion provided with axially extending slots such as indicated at 29, 30, 31 and 32 defining therebetween cylindrical segments 33, 34, 35 and 36. Each of these cylindrical segments is biased radially inwardly so that when the journalling tube 16 passes therethrough, the cylindrical segments are urged radially outwardly and thus frictionally engage with appropriate force the periphery of the journalling tube.

Figure 4:
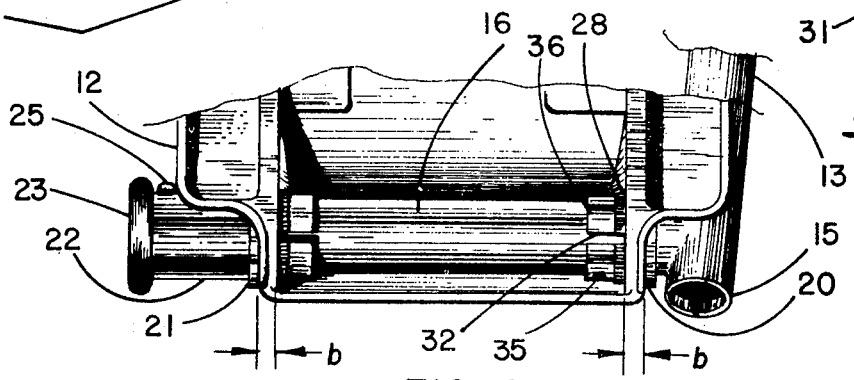

The complete assembly is illustrated in the fragmentary view of FIG. 4. It will be noted that the axial extent of the journalling openings is designated by the letter "*b*". The axial length of the various ribs 28 on the sleeves, on the other hand, is greater than the axial distance *d*. By this arrangement, after the sleeve has been inserted in the journalling opening, the urging of the journalling tube 16 therethrough exerts radially outward pressure on the inner rear portion of the sleeve thus urging the ribs 28 into tight engagement with the axial grooves over the entire length of the grooves, any excess length of the ribs being urged upwardly on either side of the periphery of the journalling opening, thus locking the sleeve against axial movement therein as well as rotational movement.

The resilient cylindrical segments such as illustrated at 35 and 36 in FIG. 4 of the friction sleeve engage the periphery of the journalling tube 16 as described heretofore and since these cylindrical segments are biased inwardly, any variation in the outside diameter of the journalling tube 16 will not affect appreciably the frictional grip. Such variations might occur as a consequence of different thicknesses of chrome plating of the tube and manufacturing tolerances and the like.

It will be understood that the sleeve 21 is received in the other journalling opening in the same manner as described with respect to the sleeve 20, the end collar 22 and end cap 23 being shown in place in FIG. 4 to hold the plate 12 axially on the journalling tube 16.

With respect to the foregoing structure, it will be understood that if for any reason the sleeves 20 and 21 become broken or damaged or simply wear out, they can be replaced by simply removing the screw 25 and sliding off the end collar 22 and end cap 23, so that the journalling tube 16 is then free to be slid to the right as viewed in FIG. 4 from the journalling openings and associated friction sleeves. The sleeves themselves can then be removed and replaced. The journalling tube 16 is then re-inserted axially within the openings to expand the new friction sleeves and secure the same in the openings as described heretofore. The collar 22 and end cap 23 are then finally placed on the end of the journalling tube to complete the overall assembly.

It will be clear that the extreme lower end 15 of the support tube 13 as viewed in FIG. 4 functions as a stop for the foot rest plate 12 when the same is swung downwardly to its horizontal position, this end 15 abutting against the under lower righthand corner of the plate 12 as viewed in FIG. 4. Similarly, the main portion of the tube 13 itself will serve as a stop for the foot rest plate 12 when it is swung upwardly into a vertical plane, the top edge of the plate 12 adjacent to the support tube 13 engaging this support tube when in the vertical plane.

It will also be appreciated from the foregoing description, that because of the frictional engagement of the cylindrical segments of the sleeves 20 and 21 with the journalling tube 16, the foot rest plate will remain in any set intermediate position between its generally horizontal position and its generally vertical position.

The material of the sleeves 20 and 21 is plastic and movement of the plate with the plastic sleeves frictionally engaging the journalling tube 16 takes place silently without any squeaking noises and very smoothly. Eventual wear, as pointed out heretofore, is compensated by the resilient nature of the cylindrical segments which are biased radially inwardly to accommodate variations in thickness and wearing away of the chrome surface of the journalling tube.

From the foregoing description, it will thus be evident that the present invention has provided a very simple and economical means for solving a long existing problem with respect to wheelchair foot rests. Not only is scratching or damage to the journalling tube for the foot rest plate avoided, but in addition, corrosion and the like is eliminated and the foot rest plate itself will properly be held in any desired swung position. The arrangement provides for a substantially maintenance-free structure and in the rare event that damage should occur to one or both of the sleeves, replacement thereof is extremely simple.

What is claimed is:

1. A wheelchair foot rest comprising, in combination:

a. an elongated support tube having an upper end adapted for securement to a wheelchair;

b. a journalling tube rigidly secured at one end adjacent to the lower end of said support tube and extending generally horizontally forwardly from said lower end to terminate in a free end;

c. a footrest plate having an integrally formed semi-cylindrical configuration along one side defining journalling openings at its ends for receiving said journalling tube such that said plate may swing from a generally horizontal plane into a generally vertical plane about an axis coaxial with said journalling tube and semi-cylindrical configuration, said journalling openings extending for given axial distances and including axial grooves about their inner peripheries; and, d. a pair of friction sleeves in said journalling openings surrounding portions of said journalling tube passing therethrough, said friction sleeves being made of plastic and including means for locking them against rotation within said journalling openings in the form of axial ribs on rear peripheral portions of the sleeves extending for an axial distance greater than said given axial distance and resilient means biased into frictional engagement with said journalling tube, said resilient means including forward cylindrical portions of the sleeves provided with slots to define cylindrical segments between the slots biased radially inwardly to thereby frictionally grip said journalling tube, whereby when said plate is swung to any desired position, it will be held in its swung position by friction between said sleeves and said journalling tube.

2. A wheelchair foot rest according to claim 1, including an end cap and collar assembly removably secured to the free end of said journalling tube, said assembly being of larger diameter than the journalling openings so that the plate is prevented from axially moving off from said journalling tube, removal of said assembly permitting the plate to be axially moved along the journalling tube until the journalling openings move off from the journalling tube so that the friction sleeves can be removed and replaced if desired.

* * * * *